US006699305B2

(12) United States Patent
Myrick

(10) Patent No.: US 6,699,305 B2
(45) Date of Patent: Mar. 2, 2004

(54) PRODUCTION OF METALS AND THEIR ALLOYS

(76) Inventor: James J. Myrick, 748 Greenwood Ave., Glencoe, IL (US) 60022

( * ) Notice: Subject to any disclaimer, the term of this patent is extended or adjusted under 35 U.S.C. 154(b) by 0 days.

(21) Appl. No.: 09/936,525

(22) PCT Filed: Dec. 8, 2000

(86) PCT No.: PCT/US00/42699

§ 371 (c)(1),
(2), (4) Date: Sep. 7, 2001

(87) PCT Pub. No.: WO01/45906

PCT Pub. Date: Jun. 28, 2001

(65) Prior Publication Data

US 2002/0184971 A1 Dec. 12, 2002

Related U.S. Application Data

(60) Provisional application No. 60/169,580, filed on Dec. 8, 2000, and provisional application No. 60/190,981, filed on Mar. 21, 2000.

(51) Int. Cl.[7] ..... B22F 9/28
(52) U.S. Cl. ..... 75/351; 75/369; 75/619
(58) Field of Search ..... 75/351, 363, 369, 75/619, 620

(56) References Cited

U.S. PATENT DOCUMENTS

| | | | | | |
|---|---|---|---|---|---|
| 2,766,111 | A | * | 10/1956 | Singleton | 75/620 |
| 2,770,541 | A | * | 11/1956 | Singleton | 75/620 |
| 3,839,020 | A | * | 10/1974 | Honma et al. | 75/363 |
| 4,698,244 | A | * | 10/1987 | Benander et al. | 427/253 |
| 6,409,797 | B2 | * | 6/2002 | Armstrong et al. | 75/619 |

* cited by examiner

*Primary Examiner*—George Wyszomierski

(57) ABSTRACT

Method for producing powdered metallic products by reacting aluminum subchloride vapor with a powdered oxide reactant such as Iron oxide, cobalt oxide, nickel oxide and boron oxide to form a solid metallic powder product mixed with aluminum oxide, together with aluminum trichloride vapor byproduct.

4 Claims, 5 Drawing Sheets

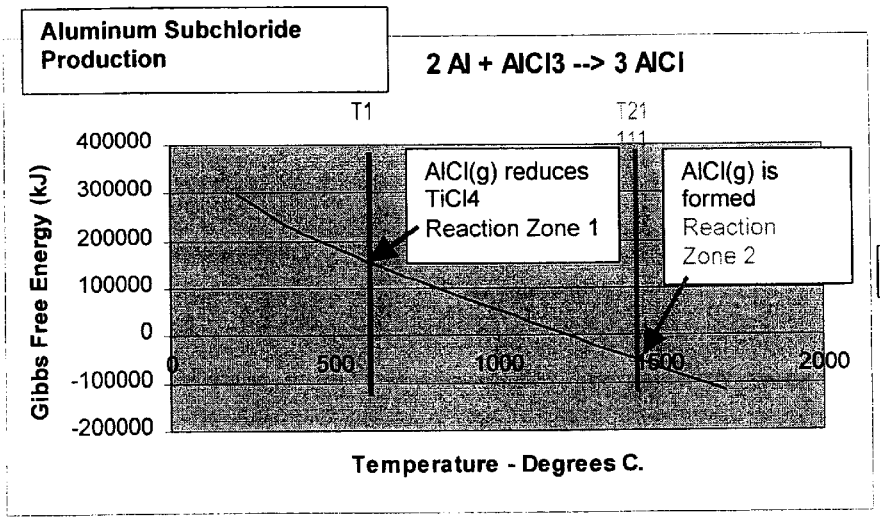
Figure 1
Figure 2, Molar Equilibrium for
2 Al(g) + $AlCl_3$(g) ⇒ 3AlCl(g)
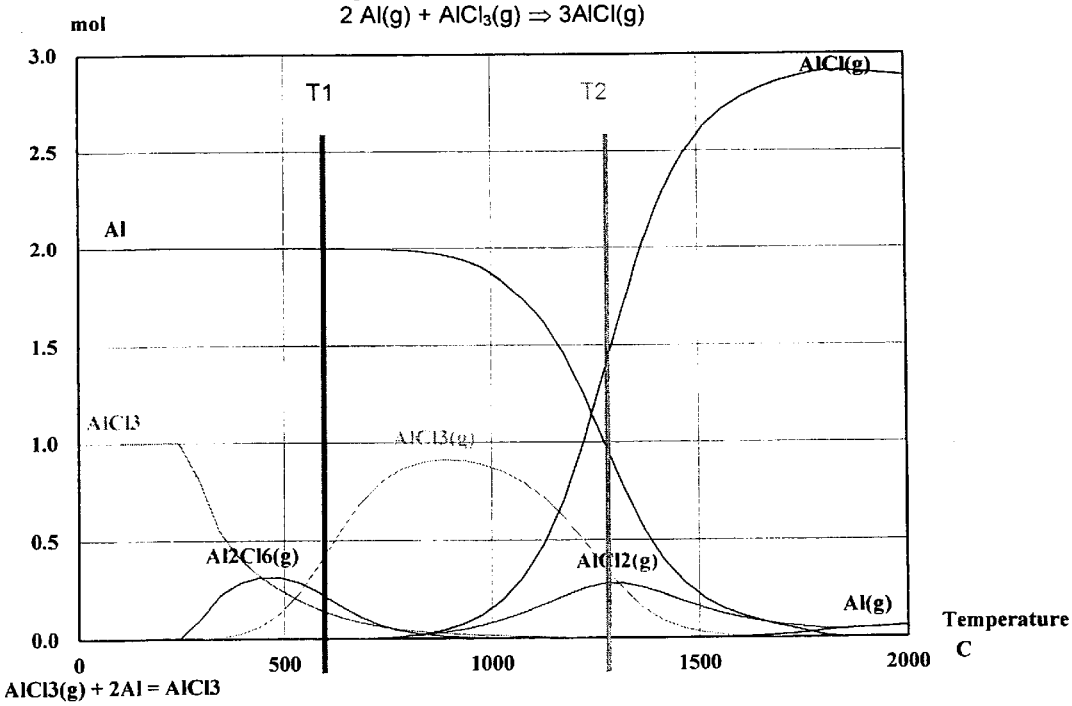

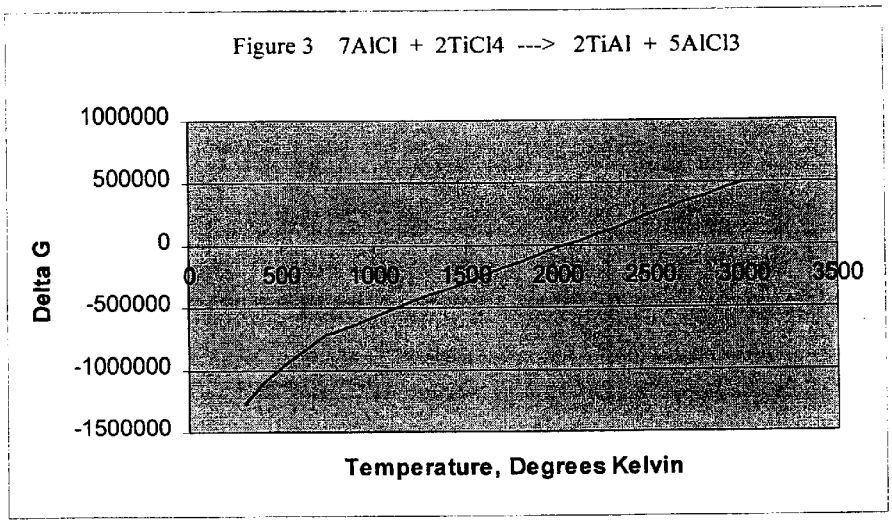
Figure 3
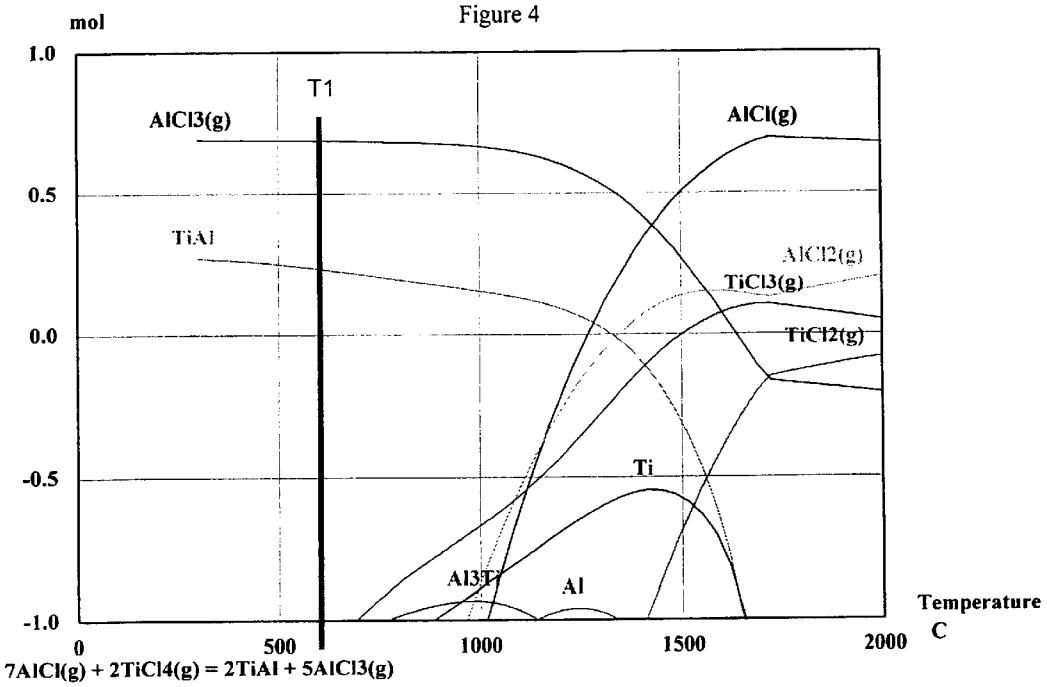

PRODUCTION OF METALS AND THEIR ALLOYS

This application is based on U.S. Provisional Applications 60/169,580 filed Dec. 8, 1999 entitled "Production of Titanium and Intermetallic Alloys" and 60/190,981 filed Mar. 21, 2000 entitled "Zirconium Production by Reactive Distillation", and PCT Application PCT/US00/42699 filed Dec. 8, 2000.

The U.S. Government may have rights in certain of the titanium aspects of the invention under SBIR Contract No. DASG60-00M-0087 with the Ballistic Missile Defense Organization.

FIELD OF THE INVENTION

The present invention is directed to the production of metals and their alloys, particularly including refractory metallic alloys such as titanium and zirconium aluminides and amorphous metals.

BACKGROUND OF THE INVENTION

As the fourth-most plentiful metal in the earth's crust, titanium is relatively abundant in nature (e.g., as rutile-$TiO_2$ and ilmenite-$FeTiO_3$, and has highly useful properties. However, this refractory metal is unfortunately relatively expensive to extract and reduce from its ores, and difficult to fabricate into useful products in view of its high melting point, sometimes requiring use of film or powder metallurgy techniques such as hot isostatic processing of a powdered or thin film form. It is difficult to purify, and even more expensive to prepare in powder form suitable for advanced powder metallurgical manufacturing processes.

Titanium is conventionally produced by reduction of titanium tetrachloride with magnesium metal in a steel batch retort (the "Kroll process"). A significant part of the high cost of titanium as a result of the inefficiency and batch nature of the Kroll process which is currently used for its manufacture. This process produces crude titanium "sponge" which may be intimately contaminated with magnesium chloride and titanium subchlorides, as well as impurities in the magnesium reducing agent. The crude titanium "sponge" which the Kroll process produces, requires costly vacuum arc refining to produce refined titanium ingots which are suitable for manufacturing use. Subsequent grinding and/or plasma particulation of the refined ingot to produce uniform powders for powder metallurgy and composite manufacture is also relatively expensive.

Titanium forms alloys and intermetallic compounds of significant technical importance. Titanium alloys, and especially titanium aluminides, are important, but costly, materials for aerospace components for propulsion and power. The relatively low density of titanium and titanium alloys, combined with their high specific stiffness, high strength, high corrosion resistance and relative toughness, are particularly desirable in aerospace systems. The efficiency of high-performance propulsion systems and turbines is limited by the high temperature capabilities of materials used for engine components. Relatively lightweight gamma-TiAl based intermetallic alloys have desirable strength to weight and other properties, particularly in comparison with the heavier titanium and nickel-base alloys currently used in combustion and compressor sections of engines. A two-phase ($TiAl+Ti_3Al$), structure distributed as fine or coarse lamellar microstructures including the $\alpha 2$ (Ti3Al), orthorhombic ($Ti_2AlNb$) and $\gamma$ (TiAl) classes of alloys may be particularly optimal for some applications. More sophisticated titanium and TiAl reinforced composite aerospace components, such as advanced SiC-fiber-reinforced titanium alloy aeroengine and structural components, are under development in many countries (including the U.S., France, the U.K. and China). Such advanced composites utilize expensive Ti or TiAl powders and/or foils in their manufacture. [see, e.g., Z. X. Guo, "Towards Cost Effective Manufacturing Of Ti/SiC Fibre Composites And Components", Materials Science and Technology, Vol. 14, pp. 864–872 (1998)].

Zirconium and its alloys are of particular use to the nuclear power industry, and chemical and materials industries, and for amorphous metal compositions. The corrosion resistance, mechanical properties and neutron transparency of Zirconium, make Zirconium-based alloys important materials for containing or alloying with uranium fuel, and for the construction of critical components of nuclear reactors. Zirconium also has a wide variety of other uses, as a getter in vacuum tubes, as an alloying agent in steel, in surgical appliances, photoflash bulbs, explosives, fiber spinnerets, and lamp filaments, and as a superconductor (with niobium) to make superconductive magnets. As a refractory metal, Zirconium can be difficult to shape and work. However, a variety of Zirconium-aluminum and similar alloys may be quenched to an amorphous, ductile state. For example, see U.S. Pat. No. 5,980,652, describing amorphous Zr—Al alloys which have significant malleability in their amorphous form. Such amorphous Zirconium alloys typically include aluminum, together with metals such as Fe, Co, Ni or Cu which promote amorphous phase formation. Bulk glass-forming metals based on Ti, Al, Zir and/or Fe which can retain their amorphous state without extremely fast cooling rates typically have three to five or more metallic components with a large atomic-size mismatch to facilitate a high packing density without crystallization. They generally form liquid melts with a small free volume and high viscosity which are energetically close to the crystalline state, because of their high packing density and short-range order, which results in slower ecrystallization kinetics and improved glass forming ability [R. Busch, "The Thermophysical Properties of Bulk Metallic Glass-Forming Liquids", *JOM,* 52 (7) (2000), pp. 39–42. A wide variety of Ti, Al, Zr, and Fe-based glass-forming alloys, such as La—Al—Ni, Zr—Ni—Al—Cu, and Zr—Ti—Cu—Ni—Be, exhibit very good bulk glass-forming ability with high thermal stability in the supercooled glass state, and low critical cooling rates [A. Inoue, et al., *Mater. Trans. JIM* 31 (1991), p. 425; T. Zhang, et al., *Mater. Trans. JIM,* 32 (1991), p. 1005; A. Inoue et al., *Mater. Trans. JIM,* 32 (1991), p. 609; A. Peker and W. L. Johnson, *Appl. Phys. Lett.,* 63 (1993), p. 2342; all cited references incorporated hereby reference]; $Zr_{41.2}Ti_{13.8}Cu_{10.0}Ni_{12.5}Be_{22.5}$ (V1) has a very low critical cooling rate of about 1 K/s, which is 5–6 orders of magnitude lower than some earlier metallic glass-forming systems. The difference in Gibbs free energy between an undercooled metal alloy glass and the corresponding crystallized alloy is the driving force for crystallization. When it is low, as in bulk glass forming alloys, glass-forming ability is high as has been done for alloys such as Zr—Ti—Cu—Ni—Be, and Cu—Ti—Zr—Ni. The Gibbs free energy difference for such "stable" glass-forming alloys may be only 2–4 Kilojoules per mole, normalized to the melting temperature of the respective alloy, even when cooled to temperatures as low as ⅓ the crystalline melting temperature of the alloy. The metal glass formers with the lowest critical cooling rates have smaller (e.g., less than 2 kJ/mole) Gibbs Free Energy differences than do the glass formers with higher critical cooling rates. The small driving force for crystallization of such bulk metal glass mixtures results from their small free volume, and their short-range order in the supercooled liquid, because the variety of atoms with different sizes in the mixture permits effective packing in the glassy state.

Amorphous alloys containing zirconium and titanium have excellent intrinsic corrosion resistance and mechanical properties, but unfortunately have been very expensive. Powder preparation for powder metallurgy manufacturing is also very expensive.

Zirconium is not scarce in nature, but is expensive to extract and reduce from its ores, because of its very high reactivity and high melting point. It is also difficult to purify magnesium chloride byproduct, and even more expensive to prepare in powder or alloy form suitable for advanced powder metallurgical manufacturing processes. Uniform alloy formation can also be an expensive processing step. Zirconiun occurs chiefly as a silicate in the mineral zircon ($ZrSiO_4$), and as an oxide in the mineral baddeleyite. Zirconium is produced commercially by reduction of chloride with magnesium (the Kroll Process), as well as other methods. Hafnium is invariably found in Zirconium ores, and the separation of Hf from Zr is difficult. Commercial-grade Zirconium accordingly contains from 1 to 3% Hafnium.

Efforts have been made to directly produce titanium powders by reduction of titanium halides in molten salts, and by ultrahigh temperature plasma treatment of $TiCl_4$, but such approaches have not yet found commercial success. Sodium fluorotitanate, $Na_2TiF_6$, dissolved in molten cryolite, can be reduced by metallic aluminum to produce a powder of metallic Ti, but requires addition of NaF in stoichiometric amount during the reaction to preserve the liquid cryolite medium, and produces large quantities of sodium fluoroaluminate byproduct. [$3Na_2TiF_6+4Al+6NaF+3Ti$, see J. Besida, et al., "The Chemical Basis of a Novel Fluoride Route to Metallic Titanium"]. Similarly, the Albany Research Center (formerly the U.S. Bureau of Mines) has investigated the reduction of titanium tetrachloride in molten chloride salts, [S. J. Gerdemann, et. al., "Continuous Production of Titanium Powder", at pp. 49–56 in "Titanium Extraction and Processing", Misra and Kipourous, ed., ISBN 0–87339–380–5 (1996); J. C. White and L. L. Oden, "Continuous Production of Granular or Powder Ti, Zr, Hf or Other Alloy Powders". U.S. Pat. No. 5,259,862,], but purity, separation, oxidation and other issues may present difficulties. Plasma thermal reduction of titanium chlorides is also a recent approach to producing titanium products, but utilizes heating to extremely high temperatures, and is accordingly very energy intensive.

Accordingly, there is a need for efficient, continuous processes to directly produce metals such as titanium and zirconium alloy powders as commodity products, and it is an object of one aspect of the present invention to provide such processes.

There is also a need to produce powder metallurgy materials for use in manufacturing reinforced intermetallic composite and amorphous metallic products, and it is an object of one aspect of the present disclosure to provide such materials and processes for manufacturing them.

BRIEF DESCRIPTION OF THE DRAWINGS

FIG. 1 is a graph of the Gibbs free energy of an aluminum monochloride formation from aluminum and aluminum trichloride as a function of temperature;

FIG. 2 is a plot of the molar functions, at equilibrium, as a function of temperature, of various aluminum and titanium chloride species;

FIG. 3 is a graph of the Gibbs free energy of a chloroaluminothermic reduction of titanium chlorides;

FIG. 4 is a plot of the molar functions, at equilibrium, as a function of temperature at atmospheric pressure, of various aluminum and titanium chloride species;

SUMMARY OF THE INVENTION

Figure 5:
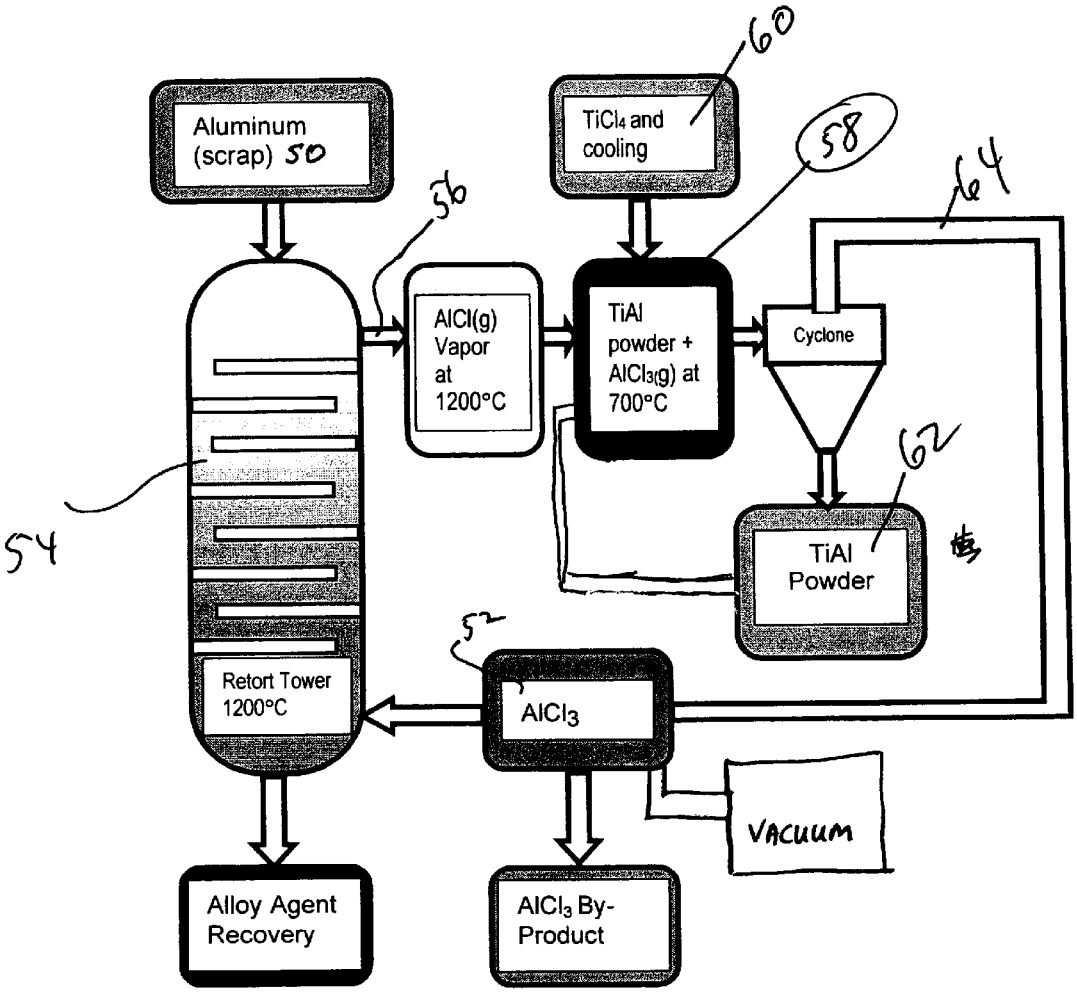
FIG. 5 is a process and equipment flow diagram of the chloroaluminothermic reduction of titanium chlorides to produce titanium aluminides.

The present invention is directed to vapor-phase processes for producing titanium and zirconium metals such as titanium and zirconium aluminides (e.g., TiAl, $Ti_3Al$, ZrAl) high-performance alloys (e.g., Ti—Al—V) and glass-forming metal alloys such as Zr—Ti—Cu—Ni—Al-based alloys. Preferred aspects of the methods may comprise the steps of generating a stream of aluminum subchloride at a temperature greater than about 1000° C. by contacting aluminum trichloride vapor with an aluminum metal-containing source preferably at a pressure in the range of from about 0.1 to about 1.5 atmosphere, mixing a titanium and/or zirconium chloride reactant with the aluminum subchloride gas to reduce the titanium and/or zirconium chloride reactant(s) to metallic titanium, or titanium or zirconium alloys and to form aluminum trichloride gas, and removing the aluminum trichloride gas from the metallic reaction product. In the processes, aluminum subchloride gas, preferably aluminum monochloride, AlCl(g), although some aluminum dichloride may also be present, is used as a vapor-phase reducing agent for titanium chloride (e.g., titanium or zirconium trichloride, or titanium or zirconium tetrachloride) vapor, to produce a metallic titanium and/or zirconium based metal, such as titanium aluminide, zirconium aluminide or titanium powder, and aluminum trichloride vapor, $AlCl_3$(g). The aluminum subchloride gas (e.g., AlCl) may be subsequently regenerated for reuse. In this regard, the aluminum trichloride to aluminum subchloride conversion cycle is relatively inexpensive, and may utilize a relatively impure aluminum source, such as scrap aluminum or an inexpensive aluminum-silicon-iron alloy formed by carbothermic reduction of bauxite. The aluminum source is reacted with $AlCl_3$(g), for example, at about 1200° C. at a pressure of 0.2 atmospheres, to form aluminum monochloride gas AlCl(g). A selected reaction material such as titanium or zirconium tetrachloride or trichloride or mixtures thereof may be introduced into, or otherwise mixed with the aluminum monochloride gas to form a reaction mixture. On cooling of AlCl gas to a temperature at which aluminum (or a titanium or zirconium aluminide) and aluminum trichloride are more stable than the aluminum subchloride vapor, (e.g., cooling toward about 600–700° C.), the aluminum monochloride is less stable and is more able to serve as a reducing agent for the zirconium and/or titanium chloride, together with any other alloying metal chlorides. The temperatures at which the "oxidation" of AlCl to $AlCl_3$, and the "reduction" of titanium chloride (and any other alloying agent and reactant) occurs to a commercially significant extent, depend upon the overall thermodynamics of the particular reaction. It is an important benefit that the reduced titanium or zirconium or titanium alloy reaction product may be produced in powder form. Coatings and solid deposits may also be provided. Unlike the standard Kroll batch process for titanium manufacture, the manufacturing process can be continuous, and can be scaled for efficient, large-scale production.

The process can be utilized to produce intimately uniform, "molecularly mixed" titanium and/or zirconium aluminide powders (e.g., TiAl, $TiAl_3$, ZrAl, $ZrAl_3$, etc.) or pure titanium powder without the need for the expensive and energy-intensive arc refining required by the current Kroll process. The process can also be adapted to incorporate other alloying agents such as niobium, to produce important titanium alloys such as Ti—Al—Nb powders, and can also be applied to include $TiB_2$ and other refractory materials of importance to powder metallurgical and thermal spray metallurgical manufacture. The AlCl vapor produced may be reacted directly with zirconium chloride introduced as a vapor, spray or powder ($ZrCl_4$, $ZrCl_3$, etc.) to produce zirconium aluminides.

Unlike the standard Kroll batch process for Zirconium and titanium manufacture, the zirconium manufacturing process is continuous, and can be scaled for efficient, large-scale production. The process is also able to produce intimately uniform, "molecularly mixed" titanium and zirconium alloys (e.g., ZrAl, $ZrAl_3$, etc.) without the need for the expensive and energy-intensive arc refining required by the current Kroll process. The process can also be extended by subsequent treatment with hydrogen and zirconium chloride to produce "pure" Zr metal powders from the alloys. The process is technically robust and can be adapted to incorporate a wide variety of alloying agents such as uranium, niobium, tin, iron, chromium and nickel, to produce a correspondingly wide variety of Zirconium alloys. The process can also be extended to process Zirconium ores in energy and material-efficient recycle operation. It may also be used, if desired, to preferentially separate Hafnium under efficient energy conditions.

The invention is also directed to reaction apparatus for manufacturing zirconium alloy powder, and to the powder so produced.

As indicated, in various aspects, the present methods may be used to produce a wide variety of intermetallic compounds such as intermetallic zirconium aluminides and titanides. Intermetallic alloys or compounds have an ordered periodic arrangement of the constituent elements, which provides a chemically bonded crystal structure rather than the solid solutions found in many conventional alloys. The methods may also be used to produce amorphous alloys.

DETAILED DESCRIPTION OF THE INVENTION

As indicated, the present disclosure is generally directed to continuous, vapor-phase process for direct manufacture of Ti, and titanium and/or zirconium alloy powders. The methods are very robust, and in addition to titanium itself, are particularly desirable for production of intermetallic TiAl, $Ti_3Al$, $TiAl_3$, FeAl, $NiAl_3$, NiAl, ZrAl, $ZrAl_3$, $Ni_3Al$, glass-forming Ti and Zr alloys, and other alloys as powders suitable for powder metallurgy fabrication. The process has inherent economies suitable for making such titanium alloys as inexpensive, commodity metals for general use, rather than as exotic materials to only be used only when their high performance is required despite their presently high cost.

The present processes use an aluminum subchloride transport reaction. In this regard, with reference to specific titanium-based embodiments, aluminum subchloride vapor is used to reduce titanium tetrachloride vapor, to directly and efficiently produce TiAl, $Ti_3Al$, $TiAl_3$ or Ti powder. A variety of different Ti and Ti and/or Zr alloy products may be produced merely by varying the reaction stoichiometry:

$$\text{For TiAl } 7AlCl+2TiCl_4 \Rightarrow 2TiAl+5AlCl_3 \quad \text{(Eq. 1)}$$

$$\text{For } Ti_3Al \ 15AlCl+6TiCl_4 \Rightarrow 2Ti_3Al+13\ AlCl_3 \quad \text{(Eq. 2)}$$

$$\text{For } TiAl_3 \ 13AlCl+2TiCl_4 \Rightarrow 2TiAl_3+7AlCl_3 \quad \text{(Eq. 3)}$$

$$\text{For Ti } 2AlCl+TiCl_4 \Rightarrow Ti+2AlCl_3 \quad \text{(Eq. 4)}$$

As shown in FIG. 1, in the aluminum subchloride transport reaction, AlCl is produced by reacting aluminum trichloride at atmospheric pressure with crude aluminum at temperatures over about 1200° C.:

$$\text{Aluminum sub-chloride production } 2Al(g)+AlCl_3(g) \Rightarrow 3AlCl(g) \quad \text{(Eq. 5)}$$

As shown in FIG. 1, the Gibbs Free Energy of the formation of aluminum monochloride from aluminum and aluminum trichloride is exothermic over about 1200° C., so that AlCl vapor can be readily formed above this temperature.

This reaction has a negative-slope Gibbs Free Energy vs. temperature curve, so that upon cooling the AlCl gas, e.g., to a temperature of 500–700° C., the free energy becomes significantly positive, aluminum is regenerated, and the vapor can become a reducing agent for the $TiCl_4$ component of a reaction mixture. FIG. 1 illustrates the Gibbs free energy of the aluminum transport reaction of Eq. (5). As shown in FIG. 1, two temperature ranges are illustrated in the reaction example described here:

Subchloride generation T1 at about 500–600° C., at which aluminum metal is generated and condensed from the vapor phase to reduce $TiCl_4$ gas, and Reduction temperature T2 at about 1200–1300° C., at which AlCl is generated FIG. 2 represents an equilibrium calculation (by Outukumpu HSC thermodynamic calculation software) of the molar concentration of aluminum subchloride and aluminum trichloride species from the reaction of Eq. (5), at thermodynamic equilibrium, over a temperature range from the sublimation point of $AlCl_3$ at about 300° C., to about 2000° C. At the reduction temperature T1, aluminum metal is a predominant equilibrium species, and $AlCl_3$ vapor (which will remove the chlorine components from the reactions of Eq. (1)–(3), is also a favored species at equilibrium conditions. At the subchloride generation temperature, T2, aluminum monochloride vapor is the predominant species at equilibrium, and $AlCl_3$ vapor is at relatively low concentration.

As indicated, the present methods can use AlCl vapor as a vapor phase reducing agent for titanium and/or zirconium chlorides, alone or mixed with other alloying or other materials. The reduction of $TiCl_3$ or $TiCl_4$ by AlCl is thermodynamically highly favored at temperatures in the T1 range of about 500–700° C., as shown by the graph of FIG. 3 for the reaction of $TiCl_4$ with AlCl, to produce TiAl powder.

The calculation of reaction product species concentration for the function of TiAl from $TiCl_4$ and AlCl according to Equation 5 at thermodynamic equilibrium (by Outukumpu HSC thermodynamic calculation software) similarly shows a very favorable exothermic reaction at the T1 temperature of 500–700° C. to form TiAl by the process without substantial formation of titanium subchlorides, which are more stable at higher temperatures. FIG. 4 shows the molar proportions of the reactants and reaction products at the T1 reaction temperature of 500–700° C. As indicated, the reaction will be further driven to completion by the reaction of Ti and Al to form TiAl, and by the separation of the metal particles from the $AlCl_3$ reaction vapor, as will be more fully discussed in connection with FIG. 5. Even at elevated temperatures, for example, between 700° C. and 1100° C. where titanium subchlorides are relatively more stable, these subchloride vapors can still be separated from metallic solids.

Aluminum subchloride vapor can also be used to reduce Zirconium tetrachloride vapor, to directly and efficiently produce ZrAl, $Zr_2Al_3$, $ZrAl_3$, $Zr_3Al$ or similar alloy powders. The different Zr alloy products may be produced merely by varying the reaction stoichiometry:

For ZrAl $7AlCl+2ZrCl_4 \Rightarrow 2\ ZrAl+5AlCl_3$ (Eq. 6)

For $Zr_2Al_3$ $17AlCl+4ZrCl_4 \Rightarrow 2\ Zr_2Al_3+11AlCl_3$ (Eq. 7)

For $ZrAl_3$ $13AlCl+2ZiCl_4 \Rightarrow 2ZrAl_3+7AlCl_3$ (Eq. 8)

As indicated, the methods and apparatus of the present invention use AlCl vapor as a vapor phase reducing agent for Zirconium tetrachloride, $ZrCl_4$. FIG. 3 is a graph of the Gibbs free energies calculated by F*A*C*T software of the $ZrCl_4$, $HFCl_4$ and $UCl_4$ reduction reactions with AlCl, and the reaction of Al with $ZrCl_4$. As shown by curves 1–3 of FIG. 3, AlCl vapor has sufficient "reducing power" to reduce highly reactive $ZrCl_4$, as well as $HfCl_4$, and $UCl_4$ which are even somewhat more difficult to reduce. However, as shown by curve 4 of FIG. 3 ($4Al+3\ ZrCl_4 \Rightarrow 3Zr+4\ AlCl_3$), the reduction of $ZrCl_4$ by aluminum to directly form pure Zirconium metal is not favored thermodynamically. Accordingly, AlCl vapor cannot be used directly to produce pure Zr metal from $ZrCl_4$ at the T1 temperature, because Aluminum metal will be produced, rather than Zr metal. Fortunately, however, Zirconium forms a wide variety of alloys with aluminum and other metals. Many of these alloys are strongly exothermic in their heats of formation, as shown by the following Table:

| Alloy | ΔH (eV/atom) | ΔH (Joules)* | ΔG (Joules) |
|---|---|---|---|
| $Zr_3Al$ | −0.3 | ***** | ***** |
| $UAl_3$ | ***** | −114,215** | −114,482 |
| $Zr_4Al_3$ | −0.425 | ***** | ***** |
| ZrAl | −0.45 | −135,000(estimated) | −9,000(estimated) |
| $TiAl_3$ | −0.475 | −142,255 | −135,948 |
| $ZrAl_3$ | −0.5 | −150,000(estimated) | 143,000(estimated) |
| $Zr_2Al_3$ | −0.525 | ***** | ***** |

*Weinert, et al., Brookhaven National Laboratory, "Ternary Transition Metal Aluminide Alloy Formation", http:/www.nersc.gov/research/anrept97/weinert.html and Phys. Rev. B.
**F*A*C*T Thermodynamic Software Calculation Because of the high heat of formation of a wide range of Zirconium-aluminum alloys, the formation of these Zr—Al alloys by direct reduction with AlCl is thermodynamically favored at temperatures in the T1 range of about 500–700° C. A calculation of Zr, Al and Cl reaction product species at thermodynamic equilibrium (calculated by Outukumpu HSC thermodynamic calculation software, substituting the values of $TiAl_3$ for ZrAl, which are similar, see the table above; the same results for $ZrAl_3$, etc.) shows a very favorable reaction at the T1 temperature of 500–700° C. to form ZrAl and related Zr—Al alloys/compounds. The following FIG. 4 shows the molar proportions of the reaction products of $7AlCl+2ZrCl_4$, (Eq. 1, above) with emphasis by red line for the proportions of the various species at the T1 reaction temperature of 500–800° C. As shown in FIG. 4, the desired products, ZrAl powder, and $AlCl_3$ gas, are by far the predominant products of the reaction at 700° C. The reaction can be further driven to completion by phase factors, which permit the separation of the Zirconium-aluminum alloy particles from the $AlCl_3$ reaction vapor, and any small amounts of subchloride produced.

While a method has been discussed for the production of intermetallic TiAl, the stoichiometric ratio of the $TiCl_4$ and AlCl reactants can be readily changed to produce other alloys, such as $Ti_3Al$ or $TiAl_3$ intermetallics, or Ti metal, in accordance with the previous reaction equations, Eq. 1–4. Reactants such as boron, niobium, iron, nickel, and/or chromium chlorides may also be included with the $TiCl_4$, to make high-performance alloys such as Ti-48Al-2Nb-2Cr, and $Ti_2AlNb$, which are inexpensive and highly uniform because their precursor chlorides are mixed in the vapor phase. Such chlorides may at least partially dissolve in titanium tetrachloride, so that even if they are not volatilized at the reduction reaction temperature range T2, they will be intimately dispensed when sprayed with the $TiCl_4$ into the reaction zone. To the extent such chlorides so not dissolve in the $TiCl_4$ to provide dispersed levels in the final metallic titanium-based product, they may also be finely ground and dispersed in a $TiCl_4$ liquid which is sprayed into the reduction reaction zone. Oxides of these alloying materials may also be used, and the resulting reaction product will contain alumina powder, which may be separated using density classification techniques, or my be retained as a ceramic reinforcing agent.

Titanium and titanium alloys are used as structural components in many aircraft, space satellites and missiles. Typical applications include Ti fan disks, turbine blades, and vanes in aircraft turbine engines, and cast and forged structures. Unalloyed titanium is used in jet engine shrouds, cases, airframe skins, firewalls, and other hot-area equipment for aircraft and missiles; and is also used in heat-exchangers, while alloys such as Ti-6Al-2Sn-4Zr-2Mo (Ti-6242, or UNS 54620) are used in gas turbine engine and air-frame applications where high strength and toughness, creep resistance, and high temperature stability at temperatures up to 450° C. (840° F.) are required. Such alloys can be made in powder form by incorporating $SrCl_2$, $ZrCl_2$, and $MoCl_2$ in the $TiCl_4$.

The present glassy alloy production process is highly energy efficient and robust, and has low energy consumption and capital investment. In the process, aluminum subchloride vapor is used to reduce mixed metal chloride vapor, to directly and efficiently produce amorphous metal alloy powders. A wide variety of different metal glass alloy products may be produced, merely by varying the reaction stoichiometry. For example, to make crystalline or bulk glass alloys such as $Zr_{52.5}Cu_{17.5}Ni_{14.5}Al_{10}Ti_5$ (10K/sec critical cooling rate) or $Zr_{57}Cu_{15.4}Ni_{12.6}Al_{10}Nb_5$ (10K/sec critical cooling rate), the following chloride vapor in appropriate stoichiometry would be blended for reaction with AlCl(g) to form the desired glass composition.

ΔG@600° C.

For ZrAl component $7AlCl(g)+2ZrCl_4 \Rightarrow 2ZrAl+5AlCl_3(g)-130$ kJ (Eq. 6)

For Ti component $2AlCl(g)+TiCl_4 \Rightarrow Ti+2AlCl_3(g)-239$ kJ (Eq. 9)

For Cu component $AlCl(g)+CuCl_2 \Rightarrow Cu+AlCl_3(g)-321$ kJ (Eq. 10)

For Nb component $5AlCl(g)+2NbCl_5 \Rightarrow 2Nb+5AlCl_3(g)-998$ kJ (Eq. 11)

For Ni component $AlCl(g)+NiCl_2 \Rightarrow 2Ni+5AlCl_3-308$ kJ (Eq. 12)

For Fe component $2FeCl_3+3AlCl(g) \Rightarrow 2Fe+3AlCl_3-773$ kJ(Eq. 13)

Other metal chlorides, such as volatile tungsten chlorides, $WCl_4$ and $WCl_5$, can also be easily reduced by AlCl(g) at 600° C. to include small amounts (e.g., 0.1–2% by weight) of this relatively large metal in the alloy composition.

For W component $5AlCl(g)+2WCl_5 \Rightarrow 2W+5AlCl_3-1568$ kJ (Eq. 14)

For ZrAl manufacture (Eq. 6) and the inclusion of Zr in glass-forming alloys, the effective equilibrium curve is similar to that of FIG. 4 for TiAl (Eq. 1).

As indicated, the present methods will reduce other metal chloride mixtures with titanium and or zirconium chlorides. Chlorides such as $NiCl_2$, $NbCl_5$ and $FeCl_3$ can be directly reduced by AlCl vapor, because the Gibbs Free Energy for their direct reduction (particularly to form alloys) is negative. Substantially all transition and rare earth metal chlorides can similarly be reduced by aluminum to form intimately mixed metal powders. Fe, Nb, Ni, Co, Cu and similar metals are easily reduced by aluminum, so crystalline and amorphous alloys containing mixtures of all of those materials can be made. AlCl(g) can even reduce refractory $ZrCl_4$. AlCl vapor cannot be used to directly produce pure Zr metal from $ZrCl_4$, because the Gibbs Free Energy for this reaction is positive in the 500–1000° C. range. Fortunately, however, zirconium is strongly exothermic in forming alloys with aluminum, and a variety of glass-forming metals. This has important implications for the manufacture of inexpensive Zr-containing bulk amorphous metal powders. Because the Gibbs Free Energy of properly formulated zirconium-aluminum bulk metal glasses only differs from that of the precipitated crystalline alloys by about 2 kJ/g-atom, which is a very small amount, the reduction by AlCl(g) of the glass alloys including zirconium metal is still thermodynamically favorable. Thus, glassy zirconium alloy formation by AlCl (g) reduction is thermodynamically favorable at reduction temperatures of less than 900° C. (e.g., 500–700° C.) because of the high heat of formation of zirconium-containing glassy alloys. ZrAl powder, and $AlCl_3$ gas, are by far the predominant products of the reaction at 700° C. The reaction is further driven to completion by phase factors, which easily permit the physical separation of the amorphous metal alloy particles from the $AlCl_3$ reaction vapor and any small amounts of subchloride produced.

A preferred example of the overall process manufacturing TiAl is illustrated in the flow diagram of FIG. 5. As shown in the flow diagram, scrap or crude aluminum 50 and aluminum trichloride 52 are reacted in a retort tower 54 at the reaction zone T2 temperature of 1200–1300° C., to produce AlCl gas 56, which is conducted to a separate reaction reactor 58 for reduction of $TiCl_4$ at the T1 reaction reactor temperature of 700° C. and 1500° C. Aluminum trichloride may be introduced as a vapor into an aluminum melt, and the aluminum melt may be "splashed" or circulated through the tower in order to increase reaction kinetics. The interior surfaces of the tower 54 should be constructed of materials such as carbon, spinels, alumina, tungsten, or even titanium or zirconium (which may be conveniently thermally sprayed on interior surfaces of the reaction vessels and conduits) or other such refractory materials which are relatively inert to reaction with aluminum and aluminum chlorides at elevated temperatures. Titanium tetrachloride 60 is mixed with the AlCl gas 56 in the T1 reaction zone 58, and the reaction mixture is cooled to a temperature of about 500–700° C. Relatively cool liquid $TiCl_4$ (molecular weight 189.7) may be sprayed into the hot AlCl gas (molecular weight 62.4) to both partially cool it and vaporize the $TiCl_4$ (note that the reaction is exothermic, in any event). Heat may be recovered for power generation heating of aluminum and/or aluminum trichloride from the reactor 58.

In the appropriate temperature range, the vapor-phase AlCl is a reducing agent for the $TiCl_4$ blended therewith, as previously discussed, to produce TiAl powder 62, and vapor-phase $AlCl_3$ gas 64. The solid TiAl powder 62 produced by the reaction may be easily separated from the aluminum trichloride vapor by a cyclone 66 or other separation system operating above the vapor point of $AlCl_3$. The powder 62 may be flushed with an inert gas such as argon, or a reversibly removable gas such as hydrogen (which can alloy with the zirconium and/or titanium metal powder at lower temperatures), to assist flushing and removal of any residual $AlCl_3$. Vacuum treatment of the collected TiAl product even at moderate temperatures, such as in the range of 100° C. to 400° C. (preferably 100–350° C.) may also be used to further remove any residual chloride components. A chloride source such as $TiCl_4$ or $ZrCl_4$ may be used with hydrogen at these low temperatures to remove aluminum from aluminum containing alloys, leaving pure titanium or zirconium. The hydrogen respectively forms Ti or Zr hydrides, which release the aluminum for removal as AlCl vapors. If desired, as shown in FIG. 5, TiAl powder may be at least partially recycled to the reactor 58 to serve as a nucleating source for metal deposition, if it is desired to increase the particle size of the TiAl or other metal powder produced by such reaction processes.

It should be noted that the process equipment is relatively simple and inexpensive, consistent with commodity production, as compared to conventional titanium batch production equipment (closed steel retorts, vacuum arc equipment, etc.), and can be easily scaled for large capacity. Conventional metal chloride tower, piping, and powder separation cyclone equipment, none of which are particularly expensive, may constitute the principal components.

The present process utilizes close coupling of distillation separation, and chemical vapor reaction systems, to improve the yields of the reaction, the production of desired alloys, and to lower energy consumption and capital investment. Energy savings can be realized, for example, when a crude carbothermic molten aluminum such as a mixture of aluminum and aluminum carbide or Al—Fe—Si alloy, and heated aluminum trichloride from specific reaction steps are separated and used as reactants in a zirconium or titanium reduction, and $TiCl_4$ or $ZrCl_4$ generation steps. The energy from the latent heat and exothermic reactions may be used to drive other reactions. The process is very robust, and produces alloys as powders suitable for powder metallurgy fabrication, and for preparation of titanium and/or zirconium-aluminum alloys. The process has inherent economies suitable for making such titanium and/or zirconium alloys as inexpensive, commodity metals for general use, rather than as exotic materials to be used only when their high performance is required despite their presently high cost. It may also be used to prepare Zr metal powder from the Zr—Al alloy by treatment with hydrogen and a chloride source such as $ZrCl_4$.

The aluminum trichloride byproduct, can also be used to directly recover titanium, zirconium, and other metals directly from their ores. An example of the overall process is further illustrated in the flow diagram of FIG. 7. As shows in FIG. 7, scrap aluminum or even less-expensive carbothermic aluminum (e.g., a mixture of molden aluminum with aluminum chloride) or crude coke-furnace reduced Al—Fe—Si, are reacted with aluminum trichloride in a reaction tower at the reaction zone T2 temperature of 1300–1500° C., to produce AlCl vapor. The furnaced crude aluminum can be introduced into the tower at high temperature (e.g., 1500–2200° C.), and this heat can be used directly in the formation of AlCl. The aluminum subchloride gas is conducted to a separate reaction zone for reduction of a glassy metal chloride mixture at the T1 temperature. Glassy metal-forming components such as $FeCl_3$, $TiCl_4$, $NbCl_5$, $NiCl_2$ and/or $ZrCl_4$, as well as $WCl_5$, may be mixed with the AlCl gas in the T1 reaction zone, and the reaction mixture cooled to a temperature of about 500–800° C. $TiCl_4$ and $ZrCl_4$, and powdered non-volatilized chlorides such as $CuCl_2$ may be used to cool the hot AlCl gas and vaporize the chlorides. Expansion through a nozzle into a partial vacuum zone can also be used to very rapidly cool the reacting chloride vapor. A partial vacuum to produce a subatmospheric pressure in the AlCl generator (e.g., 0.1 to 0.9 atmospheres) is also beneficial for the AlCl formation. A partial vacuum is relatively easy to implement for the methods described herein, because the aluminum chloride byproduct condenses to a solid at temperatures below about 200° C.

Thus, the reactant vapors may be initially mixed at a temperature above the crystallization/solidification temperature of the metal alloy (which is typically a deep eutectic with a relatively low melting point), and rapidly cooled to a temperature below the glass transition temperature of the alloy.

In the T1 reaction zone, the aluminum subchloride vapor, AlCl(g) vapor becomes a reducing agent for the Ti or Zr alloy, or glassy metal chloride mixture as previously discussed, to produce crystalline or glassy alloy powder as described by reactant formulation selection, and $AlCl_3$ vapor. The solid alloy powder produced by the reaction may be easily separated from the aluminum trichloride vapor by a cyclone or other separation system operating above the vapor point of $AlCl_3$. The separated crystalline or amorphous alloy powder may be flushed with an inert gas such as argon or hydrogen to assist removal of any residual $AlCl_3$. Small amounts of subchlorides which may be produced, are also relatively volatile at the recovery temperature, and can be removed with the $AlCl_3$. Hydrogen can be used to further remove residual chlorides as aluminum trichloride vapor at 100–300° C., preferably at subatmospheric pressure.

The ordering of these glass alloy metals of different atomic size into crystalline structures has low driving force and takes significant time, particularly if the composition has a low (1–3 kJ/mole) difference in Gibbs Free Energy between the glass and alloy states. The reduction of the mixed metal chloride vapor by aluminum can be sufficiently rapid that the glassy alloys do not have time to crystallize. If an adiabatic or other expansion nozzle is used to cool the reactants, cooling can occur at extremely high rates, of up to $10^6$ degrees K per second.

An example of the overall process and a reaction system for carrying it out is further illustrated in the flow diagram of FIG. 5. As shown in FIG. 5, scrap aluminum or even less-expensive carbothermic aluminum or crude coke-furnace reduced Al—Fe—Si, are reacted with aluminum trichloride in a distillation reaction tower at the reaction zone T2 temperature of 1200–2000° C., to produce AlCl vapor. If carbothermic aluminum is used, the heat of the latest molten metal is used efficiently in the aluminum subchloride manufacture. This reactive distillation also retains most other metals or metal chlorides in the reactive distillation tower, because of their lack of volatility. These metals and/or chlorides are in solid, non-aqueous form which permits ready reuse. The pure aluminum subchloride gas is conducted to a separate reaction zone for reduction of $ZrCl_4$ at the T1 temperature. $ZrCl_4$ is mixed with the AlCl gas in the T1 reaction zone, and the reaction mixture is cooled to a temperature of about 500–700° C. $ZrCl_4$ (molecular weight about 233) may be used to cool the hot AlCl gas (molecular weight about 62.4), and vaporize the $ZrCl_4$. In the T1 reaction zone, the aluminum subchloride vapor, AlCl(g) becomes a reducing agent for the $ZrCl_4$ as previously discussed, to produce ZrAl or other Zr-aluminide alloy powder by stoichiometry control, and $AlCl_3$ gas. The solid ZrAl alloy powder produced by the reaction may be easily separated from the aluminum trichloride vapor by a cyclone or other separation system operating above the vapor point of $AlCl_3$. The separated alloy powder may be flushed with an inert gas such as argon or hydrogen (which can alloy with the powder at lower temperatures) to assist flushing of any residual $AlCl_3$. Small amounts of subchlorides, which may be produced are also volatile at the recovery temperature, and can be removed with the $AlCl_3$. It is also important that a zirconium alloy coating can be deposited on substrates placed in the reduction zone. The substrates may be refractory substrates such as ceramic fibers or monofilaments such as silicon carbide fibers or tow, glass fibers, other metals such as uranium or uranium oxide cylinders or spherical particles steel or stainless steel fibers or reinforcing bars, conduits or other structural members at a suitable temperature in the range of, for example, 300–1500° C. The substrates may be coated in the reaction chamber in any suitable manner, such as by placing them in the reduction chamber, moving them through the zone (e.g., filaments) or utilizing a vibrating or fluidized bed with the reacting vapors. Continuous processes are particularly efficient, and benefit from the present invention. Any zirconium alloy powder may continue to be collected which does not deposit on the substrates.

Figure 6:
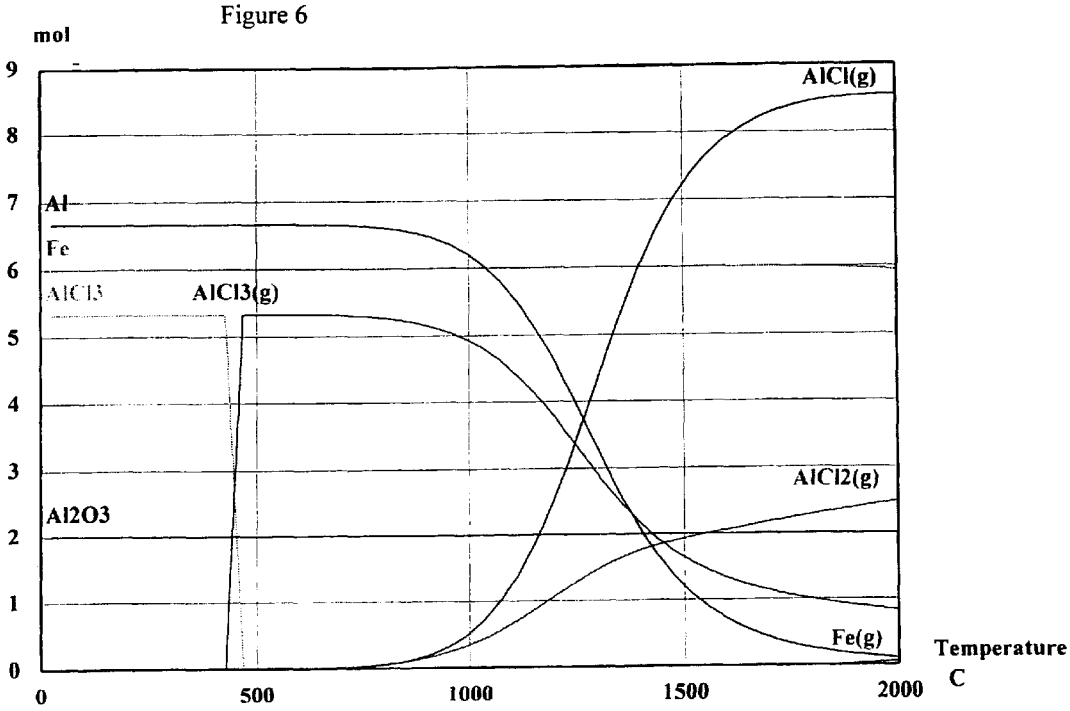
FIG. 6 is a plot of the molar fractions of various aluminum and iron chloride and oxide species in the chloroaluminothermic reduction of ferrous oxide, which may be applied to produce iron aluminide and alumina in powder form for powder metallurgy use.
Figure 7:
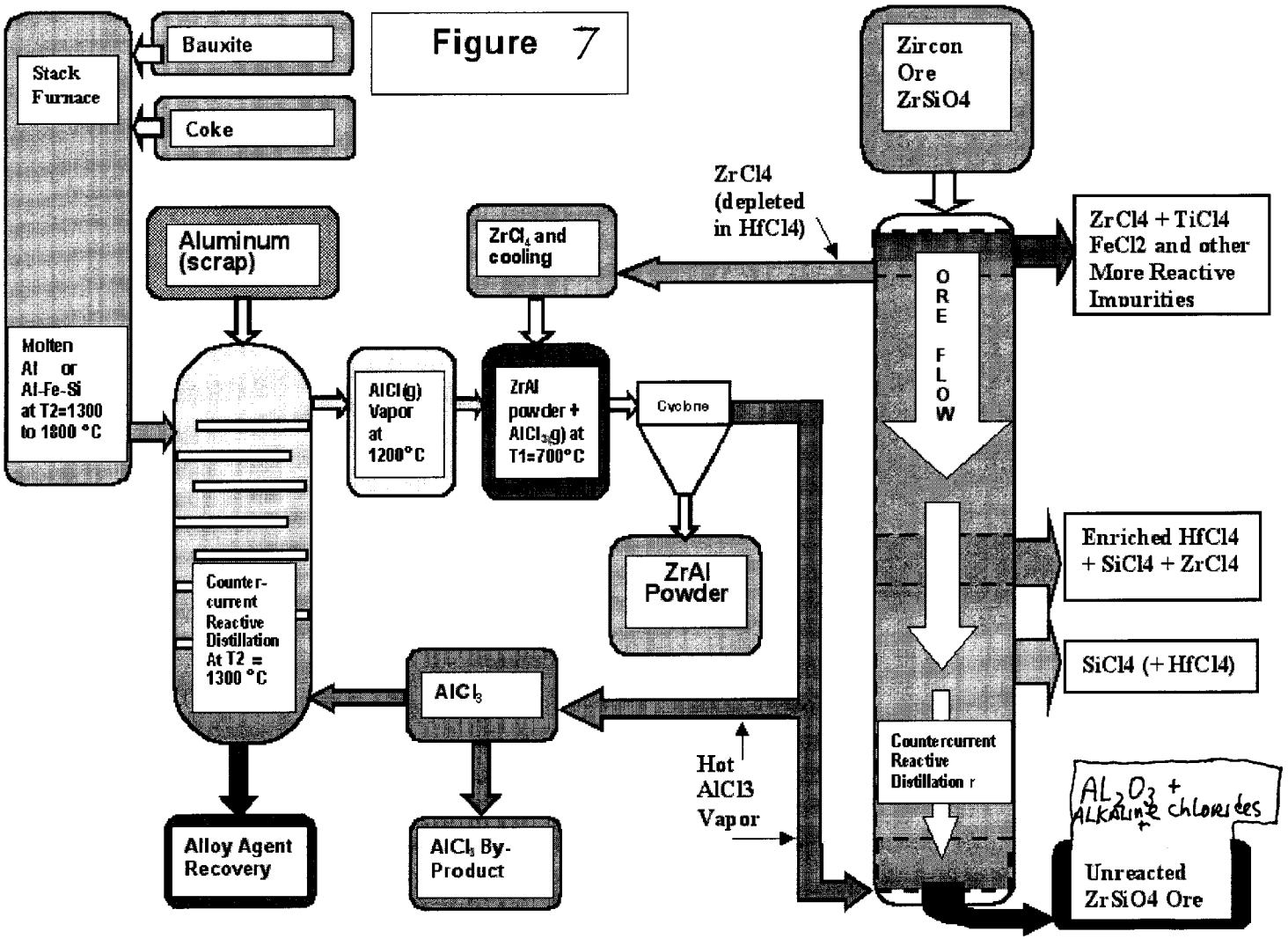
FIG. 7 is a process and equipment flow diagram of the chloraluminothermic reduction of zirconium chloride to produce zirconium aluminides, together with the refining of titanium as titanium chlorides from its ore.

As shown in FIG. 7, hot $AlCl_3$ vapor produced by the reduction of the metal chloride mixture can be recycled to regenerate the AlCl vapor. Equally important the hot $AlCl_3$ vapor can be used directly in a countercurrent distillation reactor to generate the metal chloride vapors directly from ores such as Ilmenite ($FeTiO_3$) and Zircon ($ZrSiO_4$). Direct distillation and purification of $ZrCl_4$, $TiCl_4$, $CoCl_2$, $NiCl_2$, $MnCl_2$ and other volatile metal chlorides can be carried out from their ores using $AlCl_3$ vapor byproduct. This can eliminate the costly chemical refining steps which make Ti and Zr so expensive. Other ores of constituent transition or rare earth metals can be similarly extracted with $AlCl_3$. Separation of minor chloride "impurities" is unnecessary if they are constituents of the metal alloy. The so-called "chloride reaction potential" which exploits the difference between the Gibbs Free Energy for metal oxides and metal chlorides, is used conventionally in metal chloride production towers to separate different volatile chlorides, such as $SiCl_4$, $TiCl_4$ and $FeCl_3$. (See, for example, U.S. Pat. No. 4,288,411, "Process For The Selective Production Of An Individual Plurality Of Pure Halides And/Or Halide Mixtures From A Mixture Of Solid Oxides". Because of the different "chloride reaction potentials of the Ilmenite and Zircon ore constituents, the ore can be reacted with $AlCl_3$ at elevated temperature to separate or remove different constituents of their ores, as shown at the right-hand side of FIG. 7. Because the $AlCl_3$ vapor is already heated, this is a very energy efficient process. As shown in FIG. 5, the hot $AlCl_3$ vapor produced by the reduction of $ZrCl_4$ can be recycled to the first reactive distillation tower to regenerate the AlCl vapor. Also, the hot $AlCl_3$ vapor can be used in a counter-current or other distillation reactor to generate $ZrCl_4$ from ores such as $ZrSiO_4$ (see, for example, Othmer, et al., "Halogen Affinities—A New Ordering of Metals to Accomplish Difficult Separation"), AICKE Journal (Vol. 18, No. 1) January 1972, pp.217–220) to separate the different constituents of the ore, as shown at the right-hand side of FIG. 7, above. Given the difference in "chloride reaction potential" between $HfCl_4$ and $ZrCl_4$ as shown in FIG. 6, the $HfCl_4$ impurity can also preferentially be separated from the desired $ZrCl_4$ product, if such separation is desired.

As also shown in FIG. 7, a suitable zirconium ore may be processed in a counter-current manner to efficiently recycle the hot $AlCl_3$ vapor in ore processing and component extraction. A suitable zirconium ore such as Zircon ($ZrSiO_4$) or zirconium oxide ore such as baddeleyite ($ZrO_2$) is introduced into a counter current reactor. While the reaction is shown as a chloride reaction tower, through which the ore passes downward, in practice a series of interconnected metal chloride reactors may be used, in which the vapor flows may be controlled among them to simulate counter current processing, may also be used. The reactive $AlCl_3$ vapor is introduced at the "bottom" of the column (or to the rector with the last-processed ore components), which contains the "lowest chloride potential" of the potentially volatile chloride cations (e.g., $SiCl_4$) and the previously reacted nonvolatile chloride component of the ore (e.g., $CaCl_2$ NaCl), the other volatile component having been conducted upwards as chloride vapors, as shown in FIG. 7. $SiCl_4$ and enriched $HfCl_4$ may be removed, distilled and processed. $ZrCl_4$ may similarly be recovered and distilled, if desired, while iron chlorides and other chloride reactive metals with a high chloride potential may also be recovered at appropriate temperatures along the reactor. The same result can be achieved with titanium ores such as ilmenite and rutile.

While the reaction has been discussed for the production of ZrAl (77% Zr by weight), the stoichiometric ratio of the $ZrCl_4$ and AlCl reactants can be changed to produce other alloys, ranging from $Zr_3Al$ to $ZrAl_3$. Provided the high heat of formation of the respective alloy is retained, other reactants such as Boron, Niobium, Iron, Nickel, Tin and/or Chromium chlorides may also be included with the $ZrCl_4$, to make high-performance alloys, which are inexpensive and may be highly uniform if their precursor chlorides are mixed in the vapor phase. Uranium alloys with aluminum can be produced in the same way, as well as Zr—U alloys.

Carbon-generating gases, such as aromatics and alkanes (e.g., $C_2H_2$ or benzene or $CH_4$) and halide-substituted aromatics and alkanes (e.g., $CCl_4$ or $C_6Cl_6$) may also be included to produced zirconium or other carbide components:

$$CCl_4+AlCl) \Rightarrow C=2AlCl_3 \ (\Delta G=838 \text{ kilojoules at } 1000^\circ \text{ Kelvin})$$

$$Zr+4C= \Rightarrow ZrC_4 \ (\Delta G=183 \text{ kilojoules at } 1000^\circ \text{ Kelvin})$$

$$Ti+C \Rightarrow TiC \ (\Delta G=173 \text{ kilojoules at } 1000^\circ \text{ Kelvin})$$

Fibers or surfaces of carbon organopolymers such as polyvinyl chloride or polyvinylidine chloride may be "coated" with zirconium carbide in the reduction reaction zone, when in contact with the reacting aluminum subhalide and zirconium halide vapors.

Aluminum may also be at least partially removed from the Zr—Al alloy powders, by reactively distilling them with $AlCl_3$ at a T2 temperature of 1600–1800° C. or more where AlCl and $AlCl_2$ vapor have a very negative Gibbs Free Energy:

$$ZrAl+AlCl_3 \Rightarrow Zr+AlCl(\text{vapor})+AlCl_2(\text{vapor})$$

This secondary distillation can also be used to preferentially remove Hf as Hf chlorides, because of the higher Gibbs Free Energy of the Hafnium compounds compared to Zr Chlorides, leaving enriched Zr metal powder, reduced in Hf.

The process uses very simple, scalable and inexpensive equipment and unit operations. The process is very efficient in thermal energy utilization and material reuse and can be easily scaled for large capacity. Conventional metal chloride manufacturing towers, piping, and powder separation cyclone, none of which are particularly expensive, constitute the principal components. Aluminum raw material can be very inexpensively produced in molten form using a conventional stack-type or similar carbothermic reduction furnace (see, for example, Alcoa's expired U.S. Pat. Nos. 4,299,619 and 3,971,653 to Alcoa, entitled, "Energy Efficient Production Of Aluminum By Carbothermic Reduction of Alumina").

The apparatus and process can have relatively low operating costs. The aluminum used in the process may be inexpensive scrap, aluminum carbide or crude raw aluminum such as Al or Al—Fe—Si produced at very low cost by carbothermic reduction of bauxite, which can be delivered "hot" in molten form at 1300–1800° C. for reactive distillation with $AlCl_3$ to produce AlCl. Carbothermic production of molten Aluminum directly uses the latent heat energy of the molten aluminum for the AlCl vapor production. If aluminum scrap is used, the valuable alloy components of the scrap can generally be separated and recovered by the reactive distillation in the formation of volatile AlCl, as another ecological and economic benefit of the process. In addition, even Zirconium aluminides (such as $ZrAl_3$ and ZrAl scrap or product for rework) can be used as an aluminum source for AlCl vapor production (albeit at relatively high temperatures), with the added benefit of producing a higher Zirconium content, as discussed above, for "pure" unalloyed Zr production.

The previous description has used chlorine as the halide component. Other halides may also be used, but are considerably more expensive.

The processes of FIG. 7 use relatively simple and inexpensive equipment and unit operations. Except for the AlCl vapor production, the process is a net producer of thermal energy, which can be recovered or otherwise utilized by appropriate thermal management.

An aluminum-wire or aluminum powder plasma gun to process $AlCl_3$ for AlCl production or for introducing low-volatility metal chloride reactants may also be used.

Such methods for producing powdered metallic products can comprise the steps of forming a stream of aluminum subchloride vapor at a temperature of at least about 1000° C., and preferably at least about 1100° C. A suitable oxide or halide reactant is mixed with the aluminum subchloride vapor stream. For example, the aluminum subchloride is then reacted with the metallic oxide or halide reactant, to reduce the reactant to form a solid powdered metallic product and to form aluminum trichloride vapor. The aluminum trichloride vapor can then be separated from the powdered solid metallic product. Simple cyclone or gravity separation are effective separation techniques, but filters, etc. may also be used.

For example, intermetallic iron aluminides and iron titanides may be produced by reacting iron chlorides with aluminum subchloride in a manufacturing system like that of FIG. 5.

FIG. 6 illustrates an outukumpu thermodynamic equilibrium calculation for the initial reactants 6FeO+16AlCl, calculated in terms of Fe and Al production. A slight excess of aluminum was included in the calculation to show Fe and Al as separate curves. As shown in FIG. 6, the reduction reaction of FeO and AlCl proceeds readily at temperatures below about 1200° C. In addition, the exothermic reaction of Fe and Al to form FeAl intermetallic compounds further drives the reaction to completion, to form FeAl powders.

When the iron or other metal chloride does not readily vaporize at the reaction temperatures, it may be finely ground (e.g., to a particle size of less than 44 microns, preferably less than 10 microns in maximum dimension) and introduced into the aluminum subchloride as a powder, or with a carrier such as $TiCl_4$. Similarly, metal oxides such as FeO, NiO, or CoO may be finely ground and utilized as a reactant feed stream into the aluminum subchloride vapor in the reactor system of FIG. 5, either alone or with a carrier reactant such as $TiCl_4$:

$$6FeO+15AlCl \Rightarrow 6\ FeAl+2Al_2O_3+15AlCl_3\Uparrow$$

This produces an iron aluminide intermetallic powder with about 17% of an integral alumina powder reinforcement, which is ideal for powder metallurgical manufacture of reinforced FeAl composites.

Similarly, FeTi powder may be produced by reducing FeO and titanium chlorides with AlCl in the reaction zone 58 of a system like that of FIG. 5:

$$6FeO+12AlCl+6TiCl_4 \Rightarrow 6FeTi+2Al_2O_3+12AlCl_3\Uparrow)$$

This produces an iron—titanium intermetallic alloy powder with about 15% integral alumina powder reinforcement, which is suitable for powder metallurgical manufacture of FeTi-ceramic composites.

Having described the present invention with respect to various specific embodiments, it will be appreciated that a variety of modifications and adaptations may be made which are within the spirit and scope of the present invention.

What is claimed is:

1. A method for producing powdered metallic products comprising the steps of:

forming a stream of aluminum subchloride vapor at a temperature of at least about 1000° C. and a pressure of at least 0.1 atmosphere;

mixing an oxide reactant, which may include titanium halide, with the aluminum subchloride vapor stream;

reacting the aluminum subchloride with the oxide and/or halide reactant to reduce the reactant to form a solid metallic powder product and to form aluminum trichloride vapor, and;

separating the aluminum trichloride vapor from the solid metallic product at a temperature of at learnt about 300° C.; wherein said oxide reactant comprises finely divided iron oxide, cobalt oxide, nickel oxide, boron oxide or mixtures thereof, and wherein said solid metallic powder product comprises aluminum oxide powder together with aluminum-based and/or titanium-based metallic powder and a reduced metal of said oxide reactant.

2. A method in accordance with claim 1 wherein said oxide reactant is FeO, and wherein said FeO is mixed and reacted with said aluminum subchloride vapor to form a mixture of powdered iron aluminide and aluminum oxide.

3. A method in accordance with claim 1 wherein titanium tetrachloride and an iron reactant selected from FeO, $FeCl_2$ and $FeCl_3$ or mixtures thereof, are mixed and reacted with said aluminum subchloride vapor to form an iron titanium intermetallic alloy powder.

4. A method in accordance with claim 3 wherein said iron reactant comprises at least 50 mole percent FeO, to produce an intermetallic iron titanium alloy and aluminum oxide powder.

* * * * *